US010492997B1

(12) United States Patent
Portwood

(10) Patent No.: US 10,492,997 B1
(45) Date of Patent: Dec. 3, 2019

(54) ADHESIVE BREASTFEEDING NIPPLE SHIELD

(71) Applicant: Christina Portwood, Bennet, NE (US)

(72) Inventor: Christina Portwood, Bennet, NE (US)

( * ) Notice: Subject to any disclaimer, the term of this patent is extended or adjusted under 35 U.S.C. 154(b) by 0 days.

(21) Appl. No.: 16/234,126

(22) Filed: Dec. 27, 2018

(51) Int. Cl.
*A61J 13/00* (2006.01)

(52) U.S. Cl.
CPC ..... *A61J 13/00* (2013.01)

(58) Field of Classification Search
CPC ..... A61J 13/00
USPC ..... 450/37
See application file for complete search history.

(56) References Cited

U.S. PATENT DOCUMENTS

| | | | | |
|---|---|---|---|---|
| 8,469,771 | B2 * | 6/2013 | Francis | A61J 13/00 450/37 |
| 2006/0157065 | A1 * | 7/2006 | Rohrig | A61J 13/00 128/890 |
| 2011/0065360 | A1 * | 3/2011 | Francis | A61J 13/00 450/81 |
| 2016/0220451 | A1 * | 8/2016 | Blank | A61J 13/00 |
| 2016/0296682 | A1 * | 10/2016 | Phillips | A61J 13/00 |

* cited by examiner

*Primary Examiner* — Gloria M Hale
(74) *Attorney, Agent, or Firm* — Suiter Swantz pc llo

(57) ABSTRACT

A breastfeeding nipple shield includes an extended molded adhesive flap surface and an adhesive strip on the extended molded surface attached to the rim of the areola shield portion to attach the breastfeeding nipple shield to the nursing mother's breast and retain portion in place. The adhesive flap may be elongated to distribute the load and prevent painful pulling on the breast. A molded feeding tube channel may allow a separate feeding tube to be unobtrusively inserted into the nipple opening. The feeding tube channel may be flanked by adhesive segments to secure the feeding tube in place.

20 Claims, 7 Drawing Sheets

ADHESIVE BREASTFEEDING NIPPLE SHIELD

FIELD OF THE INVENTION

Embodiments of the inventive concepts disclosed herein are directed generally toward appliances to assist in breastfeeding and more particularly toward breastfeeding nipple shields.

BACKGROUND

Breastfeeding is widely accepted to be superior to bottle feeding for infants. Breastfeeding is also difficult and painful for many new mothers. Existing nipple shields are helpful in facilitating breastfeeding and reducing pain but can become dislodged easily, hurting the mother and frustrating the infant. When they do, the mother may be placed in a very awkward position of stopping to replace the shield or proceeding without it if the shield becomes fouled by, for example, falling on the floor.

Furthermore, tandem breastfeeding twins while using existing nipple shields is functionally impossible. Existing nipple shields require the mother to use a free hand to position and hold the shield in place, at least until the infant achieves a latch. When tandem feeding twins, the nursing mother obviously does not have a free hand, and therefore cannot practically use existing shields.

It would be advantageous if an apparatus existed for facilitating breastfeeding that could be secured in place.

SUMMARY

In one aspect, embodiments of the inventive concepts disclosed herein are directed to a breastfeeding nipple shield with an extended molded surface and an adhesive strip on the extended molded surface to attach the breastfeeding nipple shield to the nursing mother's breast.

In a further aspect, a molded feeding tube channel allows a separate feeding tube to be unobtrusively inserted into the nipple opening. The feeding tube channel may be flanked by adhesive segments to secure the feeding tube in place.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which.

DETAILED DESCRIPTION

Figure 1A:
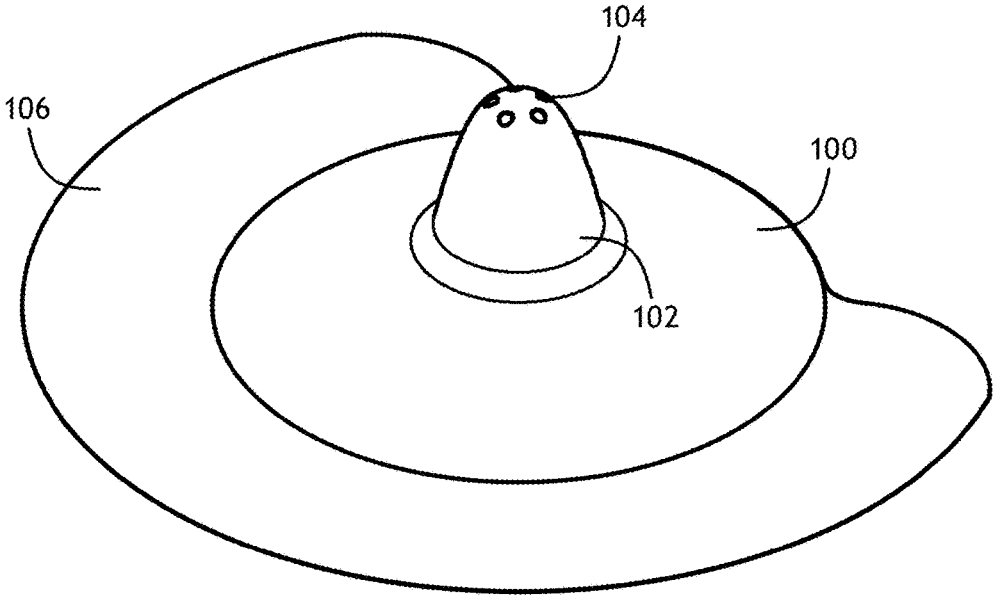
FIG. 1A shows a perspective view of an exemplary embodiment of a breastfeeding nipple shield.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1a, 1b). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a breastfeeding nipple shield with an adhesive element.

Figure 1B:
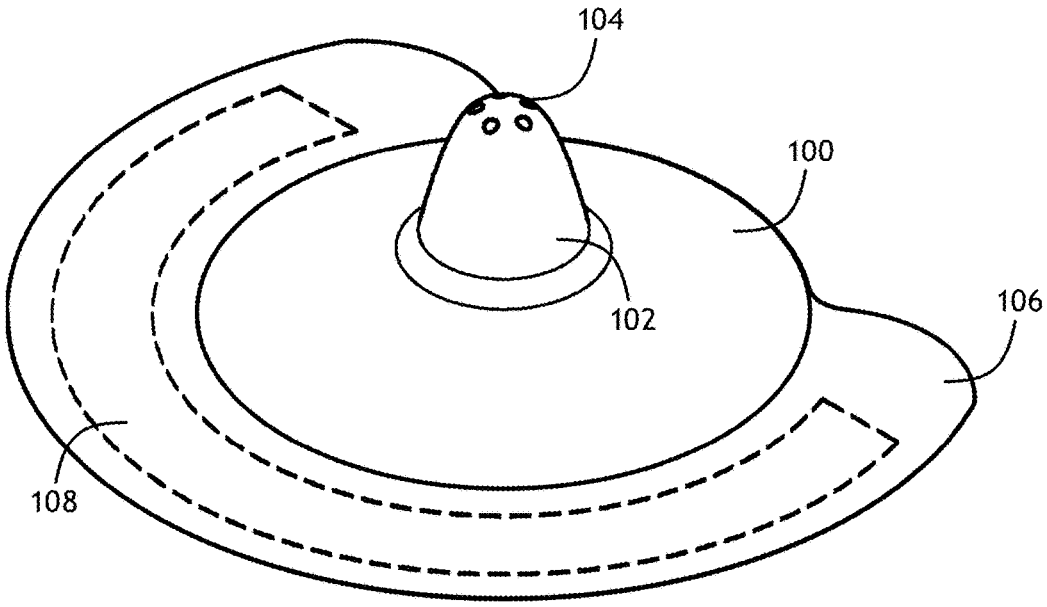
FIG. 1B shows a perspective detail view of an exemplary embodiment of the breastfeeding nipple shield of FIG. 1A.

Referring to FIGS. 1A and 1B, perspective views of an exemplary embodiment of a breastfeeding nipple shield are shown. A breastfeeding nipple shield comprises a molded portion 100 generally configured to conform to the size and shape of an areola, and a nipple portion 102 generally conforming to the size and shape of a nipple and defining one or more milk dispersing openings 104.

In at least one embodiment, the molded portion 100 is at least partially surrounded by an adhesive flap 106 configured to abut at least a portion of the breast surrounding the areola. An adhesive strip 108 is disposed on a surface of the adhesive flap 106 proximal to the breast.

In at least one embodiment, the adhesive flap 106 is molded to generally conform to the curvature of a breast. In another embodiment, the adhesive flap 106 is generally flat to facilitate manufacture and attachment of the adhesive strip 108 and corresponding adhesive backing. The adhesive flap 106 may surround less than the entirety of the molded portion 100 to allow skin-to-skin contact with the feeding infant.

In at least one embodiment, the adhesive strip 108 may comprise a waterproof, reusable adhesive such as a silicone gel coating.

Figure 2A:
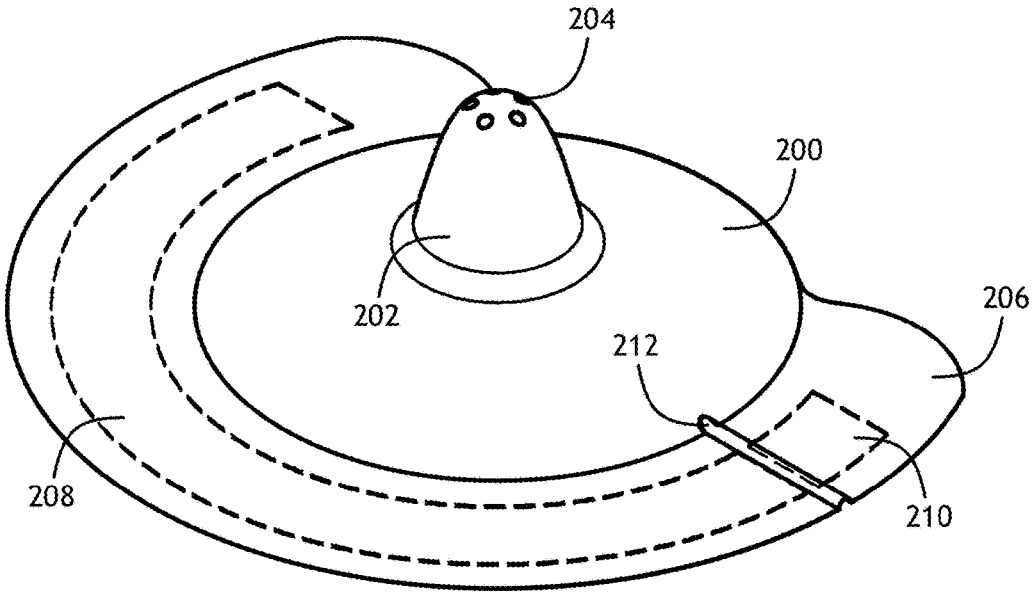
FIG. 2A shows a perspective view of an exemplary embodiment of a breastfeeding nipple shield.
Figure 2B:
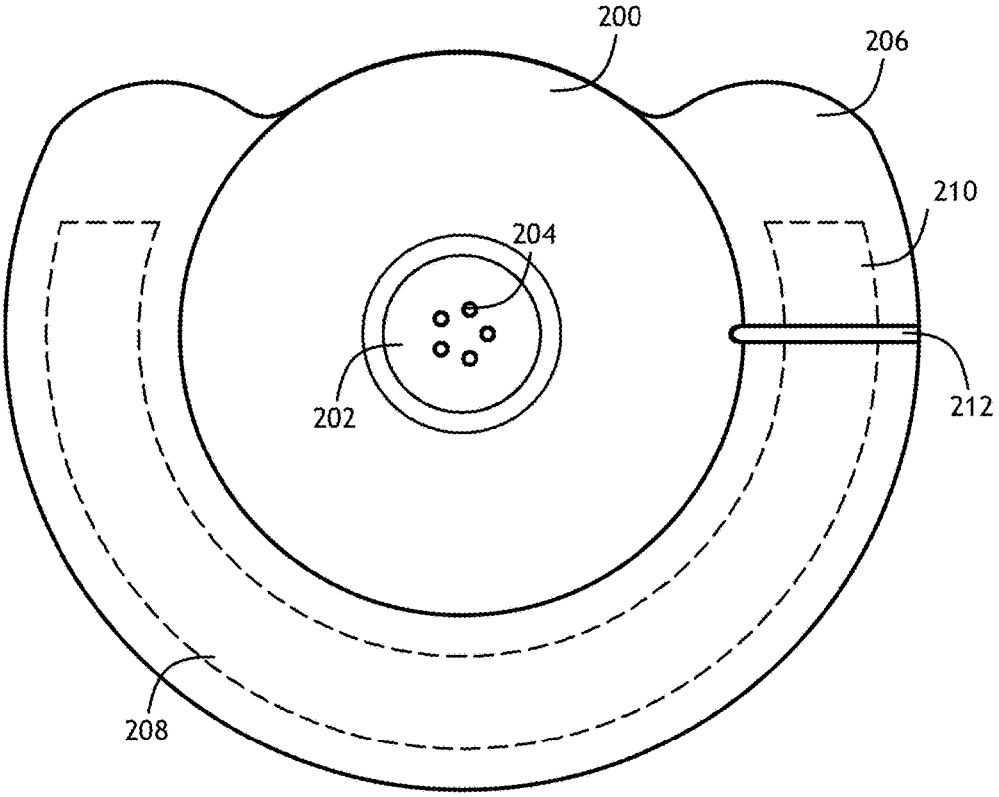
FIG. 2B shows a top view of an exemplary embodiment of the breastfeeding nipple shield of FIG. 2A.

Referring to FIGS. 2A and 2B, a perspective and top view of an exemplary embodiment of a breastfeeding nipple shield are shown. A breastfeeding nipple shield comprises a molded portion 200 generally configured to conform to the size and shape of an areola, and a nipple portion 202 generally conforming to the size and shape of a nipple and defining one or more milk dispersing openings 204. The molded portion 200 is at least partially surrounded by an adhesive flap 206 with adhesive strips 208, 210, such as an adhesive silicone gel, disposed on a surface of the adhesive flap 206 proximal to the breast.

In at least one embodiment, the adhesive flap 206 defines a feeding tube channel 212 generally conforming to the size and shape of a tube for delivering milk to the nipple portion 202 externally. The adhesive strips 208, 210 may be disposed on either side of the feeding tube channel 212 to secure the corresponding feeding tube in place.

In at least one embodiment, where the adhesive strips 208, 210 generally circumscribe the bottom and side edges of the molded portion 200, at least as high as the nipple portion 202 (that is to say extending from a line tangent to the top of the nipple portion 202, all the way around and below the nipple portion 202, back to the same tangent line), the adhesive strips 208, 210 may form a seal to prevent leakage and wastage of pumped breastmilk.

Figure 3:
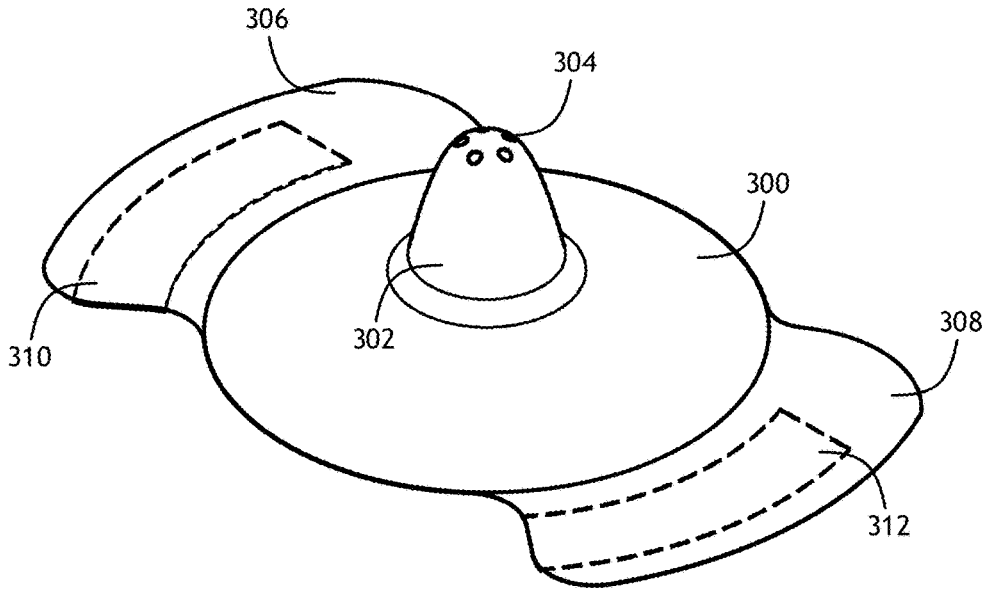
FIG. 3 shows a perspective view of an exemplary embodiment of a breastfeeding nipple shield.

Referring to FIG. 3, a perspective view of an exemplary embodiment of a breastfeeding nipple shield is shown. A breastfeeding nipple shield comprises a molded portion 300 generally configured to conform to the size and shape of an areola, and a nipple portion 302 generally conforming to the size and shape of a nipple and defining one or more milk dispersing openings 304. The molded portion 300 is at least partially surrounded by adhesive flaps 306, 308 disposed on lateral portions of the molded portion 300. Each of the adhesive flaps 306, 308 includes adhesive strips 310, 312, such as an adhesive silicone gel, disposed on a surface of the adhesive flap 306, 308 proximal to the breast. Disposal of the adhesive flaps 306, 308 on lateral portions of the molded portion 300 serves to retain the breastfeeding nipple shield in place while increases the surface area available for skin-to-skin contact.

Figure 4:
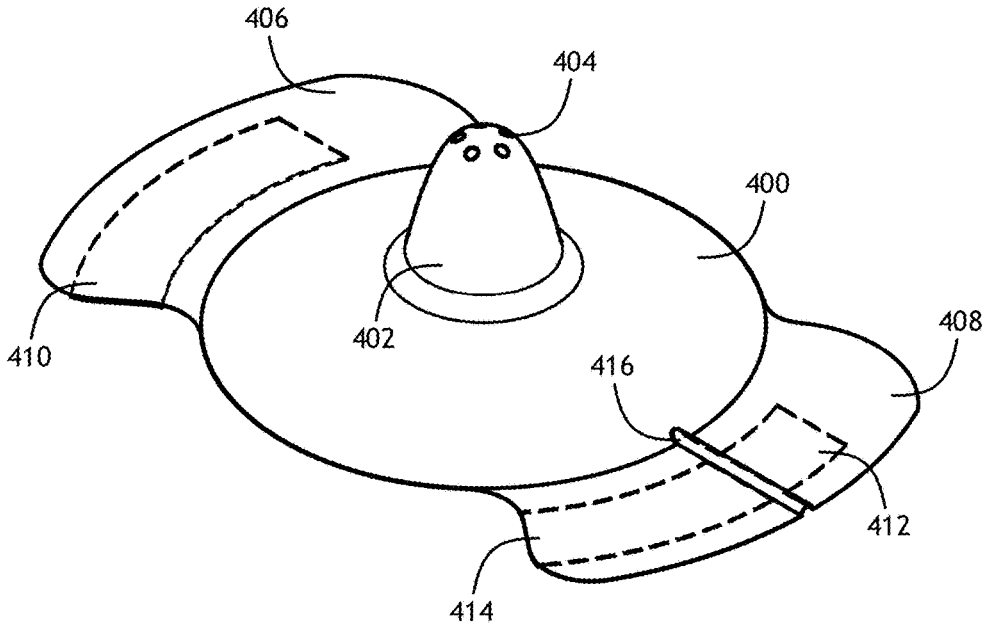
FIG. 4 shows a perspective view of an exemplary embodiment of a breastfeeding nipple shield.

Referring to FIG. 4, a perspective view of an exemplary embodiment of a breastfeeding nipple shield is shown. A breastfeeding nipple shield comprises a molded portion 400 generally configured to conform to the size and shape of an areola, and a nipple portion 402 generally conforming to the size and shape of a nipple and defining one or more milk dispersing openings 404. The molded portion 400 is at least partially surrounded by adhesive flaps 406, 408 disposed on lateral portions of the molded portion 400. Each of the adhesive flaps 406, 408 includes adhesive strips 410, 412, 414, such as an adhesive silicone gel, disposed on a surface of the adhesive flap 406, 408 proximal to the breast.

In at least one embodiment, one or more of the adhesive flaps 406, 408 defines a feeding tube channel 416 generally conforming to the size and shape of a tube for delivering milk to the nipple portion 402 externally. Adhesive strips 410, 412, 414 may be disposed on either side of the feeding tube channel 416 to secure the corresponding feeding tube in place.

Figure 5:
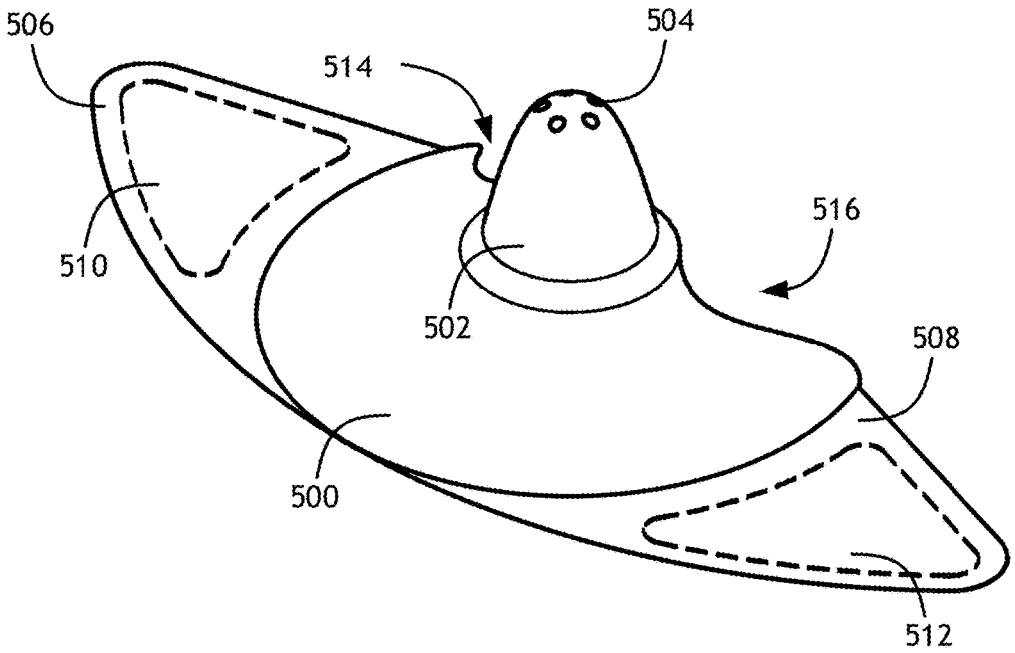
FIG. 5 shows a perspective view of an exemplary embodiment of a breastfeeding nipple shield.

Referring to FIG. 5, a perspective view of an exemplary embodiment of a breastfeeding nipple shield is shown. A breastfeeding nipple shield comprises a molded portion 500 generally configured to conform to the size and shape of an areola, and a nipple portion 502 generally conforming to the size and shape of a nipple and defining one or more milk dispersing openings 504. The molded portion 500 is at least partially surrounded by adhesive flaps 506, 508 disposed on lateral portions of the molded portion 500. Each of the adhesive flaps 506, 508 includes adhesive strips 510, 512, such as an adhesive silicone gel, disposed on a surface of the adhesive flap 506, 508 proximal to the breast. Disposal of the adhesive flaps 506, 508 on lateral portions of the molded portion 500 serves to retain the breastfeeding nipple shield in place while increases the surface area available for skin-to-skin contact.

Furthermore, the molded portion 500 may define one or more indents 514, 516 to maximize skin-to-skin contact while retaining sufficient material to hold the nipple portion 502 in place.

In at least one embodiment, the adhesive flaps 506, 508 and corresponding adhesive strips 510, 512 are elongated laterally to increase the contact surface between the adhesive flaps 506, 508 and the breast to further distribute a load along an axis unlikely to interfere with the feeding infant.

Figure 6:
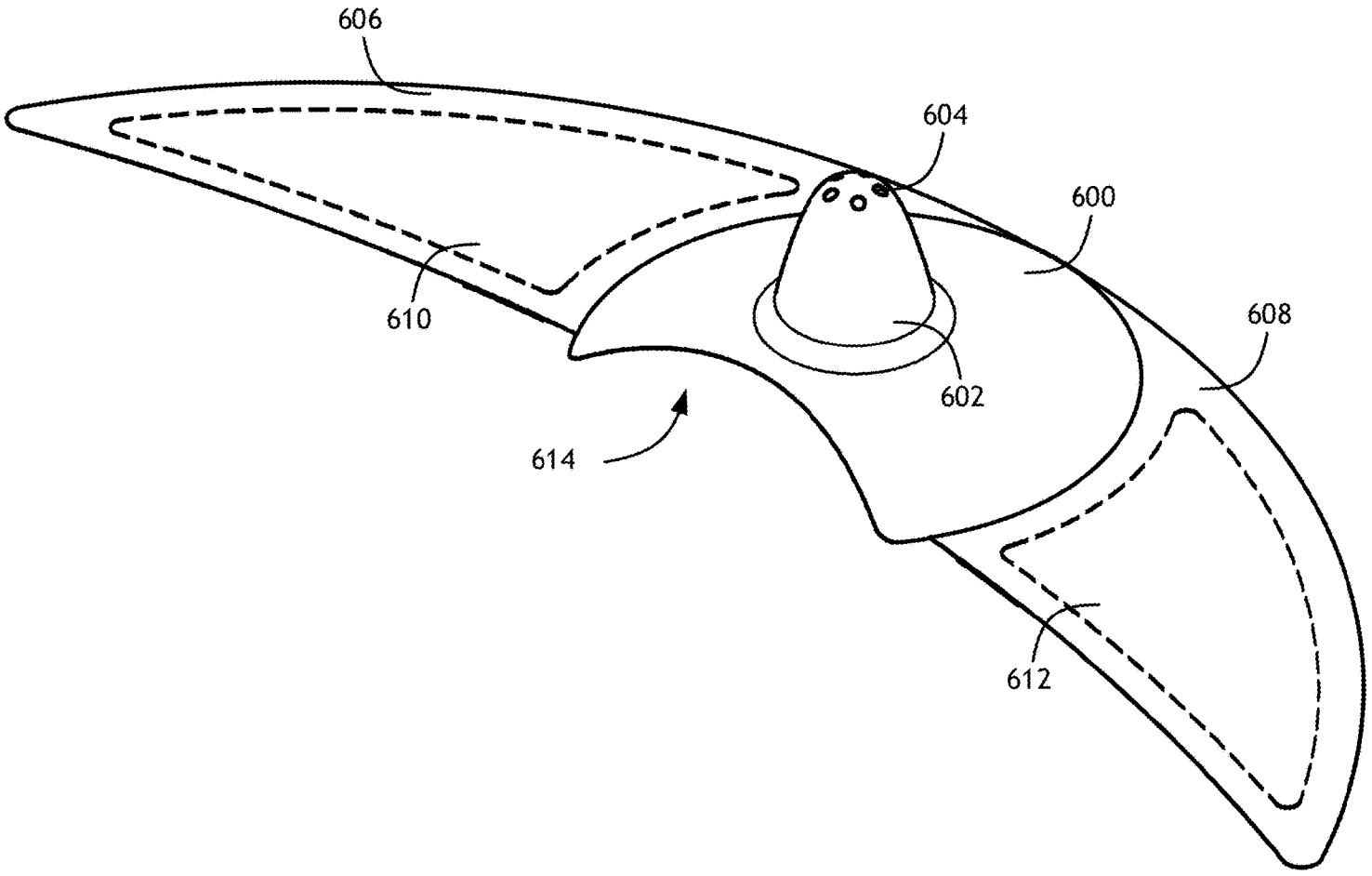
FIG. 6 shows a perspective view of an exemplary embodiment of a breastfeeding nipple shield.
Figure 7:
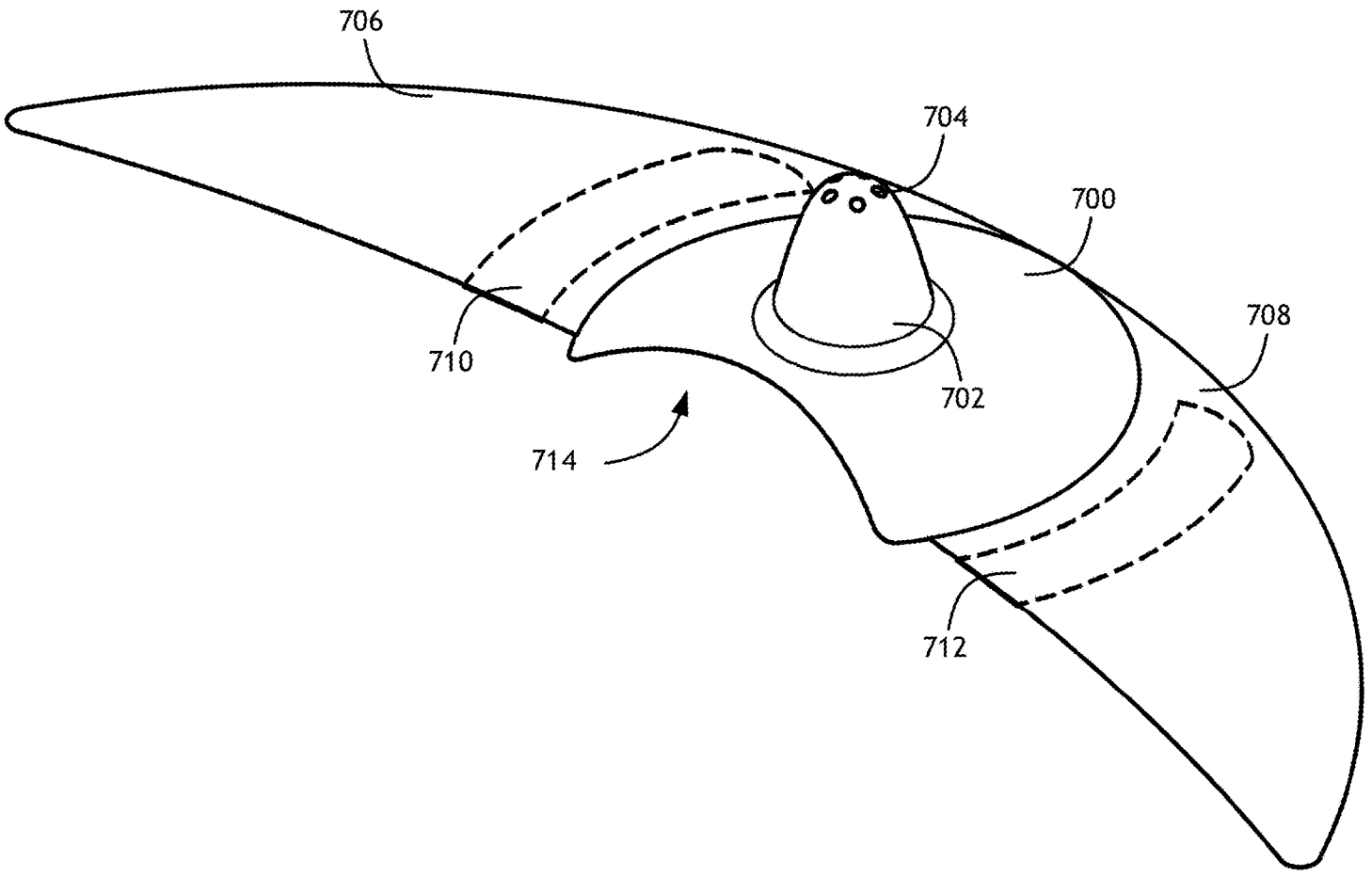
FIG. 7 shows a perspective view of an exemplary embodiment of a breastfeeding nipple shield.

Referring to FIGS. 6 and 7, perspective views of exemplary embodiments of breastfeeding nipple shields are shown. A breastfeeding nipple shield comprises a molded portion 600, 700 generally configured to conform to the size and shape of an areola, and a nipple portion 602, 702 generally conforming to the size and shape of a nipple and defining one or more milk dispersing openings 604, 704. The molded portion 600, 700 is at least partially surrounded by adhesive flaps 606, 706, 608, 708 disposed on lateral portions of the molded portion 600, 700. Each of the adhesive flaps 606, 706, 608, 708 includes adhesive strips 610, 710, 612, 712, such as an adhesive silicone gel, disposed on a surface of the adhesive flap 606, 706, 608, 708 proximal to the breast. Disposal of the adhesive flaps 606, 706, 608, 708 on lateral portions of the molded portion 600, 700 serves to retain the breastfeeding nipple shield in place while increases the surface area available for skin-to-skin contact.

Furthermore, the molded portion 600, 700 may define one or more indents 614, 714 to maximize skin-to-skin contact while retaining sufficient material to hold the nipple portion 602, 702 in place.

In at least one embodiment, the adhesive flaps 606, 706, 608, 708 and corresponding adhesive strips 610, 612 are elongated laterally to wrap around the surface of the breast and increase the contact surface to further distribute the load along an axis unlikely to interfere with the feeding infant. It will be appreciated that, even where the adhesive flaps 606, 706, 608, 708 are elongated laterally, adhesive strips 710, 712 generally and narrowly conforming to shape of the molded portion 600, 700 are still operative to retain the breastfeeding nipple shield in place.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. A breastfeeding nipple shield comprising:
a molded portion;
a nipple portion defining one or more milk dispersing openings;
at least one adhesive flap disposed on a rim of the molded portion; and
at least one adhesive strip disposed on a surface of the adhesive flap proximal to a breast during use.

2. The breastfeeding nipple shield of claim 1, wherein the molded portion defines one or more indents configured to increase skin-to-skin contact during use.

3. The breastfeeding nipple shield of claim 1, wherein the at least one adhesive flap comprises a single adhesive flap configured to partially surround the molded portion.

4. The breastfeeding nipple shield of claim 3, wherein the adhesive flap surrounds the molded portion at least from a first segment of a line tangent to the nipple portion to a second segment of the line tangent to the nipple portion.

5. The breastfeeding nipple shield of claim 4, further comprising a feeding tube channel defined by the adhesive flap.

6. The breastfeeding nipple shield of claim 5, wherein a first adhesive strip is disposed on a first side of the feeding tube channel and a second adhesive strip is disposed on a second side of the feeding tube channel.

7. The breastfeeding nipple shield of claim 1, wherein the at least one adhesive flap comprises a first adhesive flap disposed on a first edge of the molded portion and a second adhesive flap disposed on a second edge of the molded portion, the first edge being opposite the second edge.

8. The breastfeeding nipple shield of claim 7, wherein the first adhesive flap and second adhesive flap are elongated along an axis defined by the first edge and the second edge.

9. A breastfeeding nipple shield comprising:
a molded portion;
a nipple portion defining one or more milk dispersing openings;
at least one adhesive flap disposed on a rim of the molded portion;
a feeding tube channel defined by the at least one adhesive flat; and
at least one adhesive strip disposed on a surface of the adhesive flap proximal to a breast during use.

10. The breastfeeding nipple shield of claim 9, wherein the molded portion defines one or more indents configured to increase skin-to-skin contact during use.

11. The breastfeeding nipple shield of claim 9, wherein the at least one adhesive flap comprises a single adhesive flap configured to partially surround the molded portion.

12. The breastfeeding nipple shield of claim 9, wherein the at least one adhesive strip comprises a reusable silicone gel adhesive.

13. The breastfeeding nipple shield of claim 9, wherein the at least one adhesive flap comprises a first adhesive flap disposed on a first edge of the molded portion and a second adhesive flap disposed on a second edge of the molded portion, the first edge being opposite the second edge.

14. The breastfeeding nipple shield of claim 7, wherein the first adhesive flap and second adhesive flap are elongated along an axis defined by the first edge and the second edge.

15. A breastfeeding nipple shield comprising:
a molded portion configured to extend to an edge of a corresponding areola;
a nipple portion defining one or more milk dispersing openings;
at least one adhesive flap disposed on a rim of the molded portion; and
at least one adhesive strip disposed on a surface of the adhesive flap proximal to a breast during use,
wherein the at least one adhesive flap is configured to generally conform to the curvature of a corresponding breast.

16. The breastfeeding nipple shield of claim 15, wherein the at least one adhesive flap comprises a single adhesive flap configured to partially surround the molded portion.

17. The breastfeeding nipple shield of claim 15, further comprising a feeding tube channel defined by the adhesive flap.

18. The breastfeeding nipple shield of claim 17, wherein a first adhesive strip is disposed on a first side of the feeding tube channel and a second adhesive strip is disposed on a second side of the feeding tube channel.

19. The breastfeeding nipple shield of claim 15, wherein the at least one adhesive flap comprises a first adhesive flap disposed on a first edge of the molded portion and a second adhesive flap disposed on a second edge of the molded portion, the first edge being opposite the second edge.

20. The breastfeeding nipple shield of claim 19, wherein the first adhesive flap and second adhesive flap are elongated along an axis defined by the first edge and the second edge.

* * * * *